US008668159B2

(12) United States Patent
Tondkar et al.

(10) Patent No.: US 8,668,159 B2
(45) Date of Patent: Mar. 11, 2014

(54) FOLDED PERFORATED WEB

(75) Inventors: Kaveh Tondkar, Hisings Backa (SE); Lars Fingal, Gothenburg (SE); Mikael Strandqvist, Lindome (SE); Susanne Gungner, Alvangen (SE)

(73) Assignee: SCA Hygiene Products AB, Gothenburg (SE)

( * ) Notice: Subject to any disclaimer, the term of this patent is extended or adjusted under 35 U.S.C. 154(b) by 750 days.

(21) Appl. No.: 12/809,638

(22) PCT Filed: Dec. 19, 2007

(86) PCT No.: PCT/SE2007/051037

§ 371 (c)(1),
(2), (4) Date: Jun. 21, 2010

(87) PCT Pub. No.: WO2009/078774

PCT Pub. Date: Jun. 25, 2009

(65) Prior Publication Data

US 2010/0270412 A1 Oct. 28, 2010

(51) Int. Cl.
*B65H 18/28* (2006.01)

(52) U.S. Cl.
USPC ..... 242/160.4; 206/409; 225/106

(58) Field of Classification Search
USPC ..... 242/160.1, 160.4, 579, 580, 587, 587.1, 242/587.2, 593; 225/106; 206/409
See application file for complete search history.

(56) References Cited

U.S. PATENT DOCUMENTS 3,301,746 A 1/1967 Sanford et al.
3,592,161 A * 7/1971 Hoffmann ..... 118/122
3,826,361 A * 7/1974 Heckrodt ..... 206/409
3,849,241 A 11/1974 Butin et al.
4,340,563 A 7/1982 Appel et al.
4,374,888 A 2/1983 Bornslaeger
4,529,480 A 7/1985 Trokhan
4,535,912 A * 8/1985 Bonk ..... 221/46
4,597,494 A * 7/1986 Benoit ..... 206/390
5,073,235 A 12/1991 Trokhan
5,350,624 A 9/1994 Georger et al.
6,168,558 B1 * 1/2001 Vinberg ..... 493/196
6,286,680 B1 * 9/2001 Hofrichter ..... 206/554
7,354,598 B2 * 4/2008 Masting ..... 424/443
2004/0191300 A1 9/2004 Fecht et al.

(Continued)

FOREIGN PATENT DOCUMENTS

AU 2 876 577 B 12/1977
CN 2508677 Y 9/2002

(Continued)

OTHER PUBLICATIONS

Chinese Office Action, dated Jul. 23, 2012, from corresponding Chinese application.

(Continued)

*Primary Examiner* — William A Rivera

(74) *Attorney, Agent, or Firm* — Drinker Biddle & Reath LLP

(57) ABSTRACT

A web, such as a tissue or nonwoven web. Perforation lines in the web define sheets. The web is folded before being rolled or stacked, such that the intersection of the perforation lines and the folding line provides reliable dispensing. The web in roll or stack form, a method for forming the web, and a dispenser adapted for dispensing the web are also described.

19 Claims, 9 Drawing Sheets

(56) References Cited

U.S. PATENT DOCUMENTS

| | | | |
|---|---|---|---|
| 2005/0186167 | A1 | 8/2005 | Ueda et al. |
| 2006/0184148 | A1 | 8/2006 | Butsch et al. |
| 2007/0262187 | A1 | 11/2007 | Malecot et al. |

FOREIGN PATENT DOCUMENTS

| | | | |
|---|---|---|---|
| EP | 0 258 515 | A1 | 3/1988 |
| EP | 0 667 612 | A2 | 10/1995 |
| EP | 0 953 516 | A1 | 11/1999 |
| EP | 1 333 868 | B1 | 3/2007 |
| EP | 1 667 563 | B1 | 3/2009 |
| GB | 2 002 327 | A | 2/1979 |
| GB | 2 400 596 | A | 10/2004 |
| WO | 98/37794 | A1 | 9/1998 |
| WO | 99/37747 | A1 | 7/1999 |
| WO | 01/13880 | A1 | 3/2001 |
| WO | 03/069038 | A1 | 8/2003 |
| WO | 2006/080869 | A1 | 8/2006 |
| WO | 2006/130057 | A1 | 12/2006 |

OTHER PUBLICATIONS

International Search Report, dated Sep. 15, 2008, from corresponding PCT application.

* cited by examiner

FOLDED PERFORATED WEB

TECHNICAL FIELD

The present invention relates to a web, such as a tissue or nonwoven web, and a dispenser for said web. The invention also relates to the web in the form of a roll or stack, and methods for making the web, the roll and the stack.

BACKGROUND OF THE INVENTION

Dispensers for webs, such as tissue paper or nonwoven webs are well known. They can be divided into two general types. The first type comprises stack dispensers in which the web to be dispensed is stored in stacks inside the dispenser, and adjacent sheets of the web are interfolded or joined in some way. Dispensers of the second type are roll dispensers, in which the web to be dispensed is stored in the dispenser on a roll.

WO 98/37794 discloses rolled and folded napkins, which can be dispensed individually or two or three at a time as desired, depending on the dispensing method.

US 2006/0184148 describes folded fibrous structures, which may be in roll form.

GB 2 400 596 describes a roll of frangibly connected portions. The presence of frangible connections obviates the need for perforations.

GB 2 002 327 discloses a wet tissue container in which a drawing member is made of highly elastic material with a fine diameter hole through which tissue is drawn.

EP 0 953 516 discloses a tissue box in which the dispensing insert is made of a material with high resilience, so that it reverts to its initial shape without losing its elastic properties.

The present invention addresses problems associated with known webs and dispensers. One problem with known dispensers and their associated webs is ensuring that the web is dispensed in a consistent manner, i.e. that the same length of web is dispensed each time. To achieve this, a web is often perforated to define sheets. However—in particular if the dispenser only has a small opening, as in GB 2 002 327—the web may become folded, or twisted ("roped") at the point of dispensing, so that the perforation line between adjacent sheets also becomes twisted or deformed. The perforation line therefore becomes less able to promote accurate separation of the sheets along its length (i.e. across the width of the web). As a result, the web can tear at undesired positions, or fail to tear at all. The outcome is often double-dispensing, in which two sheets are dispensed simultaneously.

Another problem associated with dispensers and their webs is that the free end of the web often falls back inside the dispenser, or the web breaks within the dispenser, meaning that a user has to open the dispenser each time, locate the free end of the web and thread it through the dispensing opening. Furthermore, if the web in the dispenser is moist (i.e. wet wipes), is needs to be prevented from drying out.

Despite developments in the field of web dispensers, there remains a need for a dispenser for web stored in roll or stack form, from which easy, consistent dispensing of the web is possible.

SUMMARY OF THE INVENTION

The present invention provides a web, such as a tissue or nonwoven web. The web has a primary extension in a longitudinal direction (L) and is defined by first and second longitudinal edges and first and second ends. The web comprises a plurality of sheets, arranged in an end-to-end fashion in the longitudinal direction (L). Each sheet is defined by a portion of the first and second longitudinal edges of the web and by perforation lines which extend between said first and second longitudinal edges. The perforation lines comprise at least one perforation. The web is folded along at least one fold axis, each of which lies in the longitudinal direction (L) of the web and crosses said perforation lines. At each point at which each of said at least one fold axis crosses each perforation line, the fold axis coincides with a perforation.

The web is suitably folded along one fold axis lying in the longitudinal direction of the web, which is preferably located the same distance from each longitudinal edge.

Each perforation line may comprise alternating perforation tags and perforations, such that adjacent sheets are connected solely by said perforation tags. Preferably, each perforation line extends substantially in a transverse direction (T), being perpendicular to the longitudinal direction (L) in the plane of the web. The extension of the perforations in the direction of the perforation line is suitably greater than the extension of the perforation tags in the direction of the perforation line. For instance, the extension of the perforations in the direction of the perforation line may be at least twice, preferably at least five times, more preferably at least ten times, most preferably at least twenty times, the extension of the perforation tags in the direction of the perforation line. Suitably, each perforation tag has an extension in the direction of the perforation line which is less than 5 mm, preferably less than 3 mm, more preferably less than 2 mm, most preferably less than 1 mm.

The web may be a tissue web or a nonwoven web. It may also be a wet-wipe. The wet-wipe may be impregnated with an emulsion.

The invention also relates to the web as defined above in the form of a roll, wherein the web has been rolled about the first or second end. The invention further relates to the web in the form of a stack, wherein the web has been folded along a plurality of transverse fold axes each of which lies perpendicular to the longitudinal direction (L).

The invention provides a method for forming a web as defined herein, said method comprising the steps of:

a. providing a web having a primary extension in a longitudinal direction (L) and being defined by first and second longitudinal edges and first and second ends;

b. providing the web with longitudinally-spaced perforation lines which extend between said first and second longitudinal edges and comprise at least one perforation;

c. folding the perforated web about at least one fold axis, each of which lies in the longitudinal direction of the web; such that, at each point at which the at least one fold axis crosses each perforation line, the fold axis coincides with a perforation.

The invention provides another method for forming a web as defined herein, said method comprising the steps of:

a. providing a web having a primary extension in a longitudinal direction (L) and being defined by first and second longitudinal edges and first and second ends;

b. folding the perforated web about at least one fold axis, each of which lies in the longitudinal direction of the web;

c. providing the folded web with longitudinally-spaced perforation lines which extend between said fold axis and first and second longitudinal edges and which comprise at least one perforation, such that, at each point at which the at least one fold axis crosses each perforation line, the fold axis coincides with a perforation.

In a development of the above methods, a web may be formed in a roll, in which case, the methods additionally comprise the step of; rolling the folded, perforated web into a roll about the first or second end. If a stack is to be formed, the methods additionally comprise the step of; folding the folded, perforated web along a plurality of transverse fold axes each of which lies perpendicular to the longitudinal direction (L).

The invention also relates to a dispenser comprising the web described herein. The dispenser further comprises a dispensing opening through which said web is dispensed. The dispensing opening may have a form selected from the group consisting of: circular, square, rectangular or slit-shaped. The dispensing opening may be located in a dispensing insert, said insert being formed of an elastic material, preferably silicone. The dispensing opening suitably has an area of between 0.8 $mm^2$-20 $mm^2$, such as between 1 $mm^2$-10 $mm^2$. The dispenser may further comprise a cap adapted to cover the dispensing opening when the dispenser is in use.

BRIEF DESCRIPTION OF THE DRAWINGS

The invention will now be described with reference to the non-limiting embodiments illustrated in the Figures and described below, in which.

DEFINITIONS

It should be noted that the term "perforation" is intended to include openings produced in a web by any means, and not only openings that have been made by piercing or cutting the web. Individual sheets may be manufactured and connected together along only parts of their edges, leaving one or more openings between the connections.

A "tab" used to interconnect two adjacent sheets may be an integral part of the web material, or may comprise material that is added to the web.

DETAILED DESCRIPTION OF PREFERRED EMBODIMENTS

Figure 1:
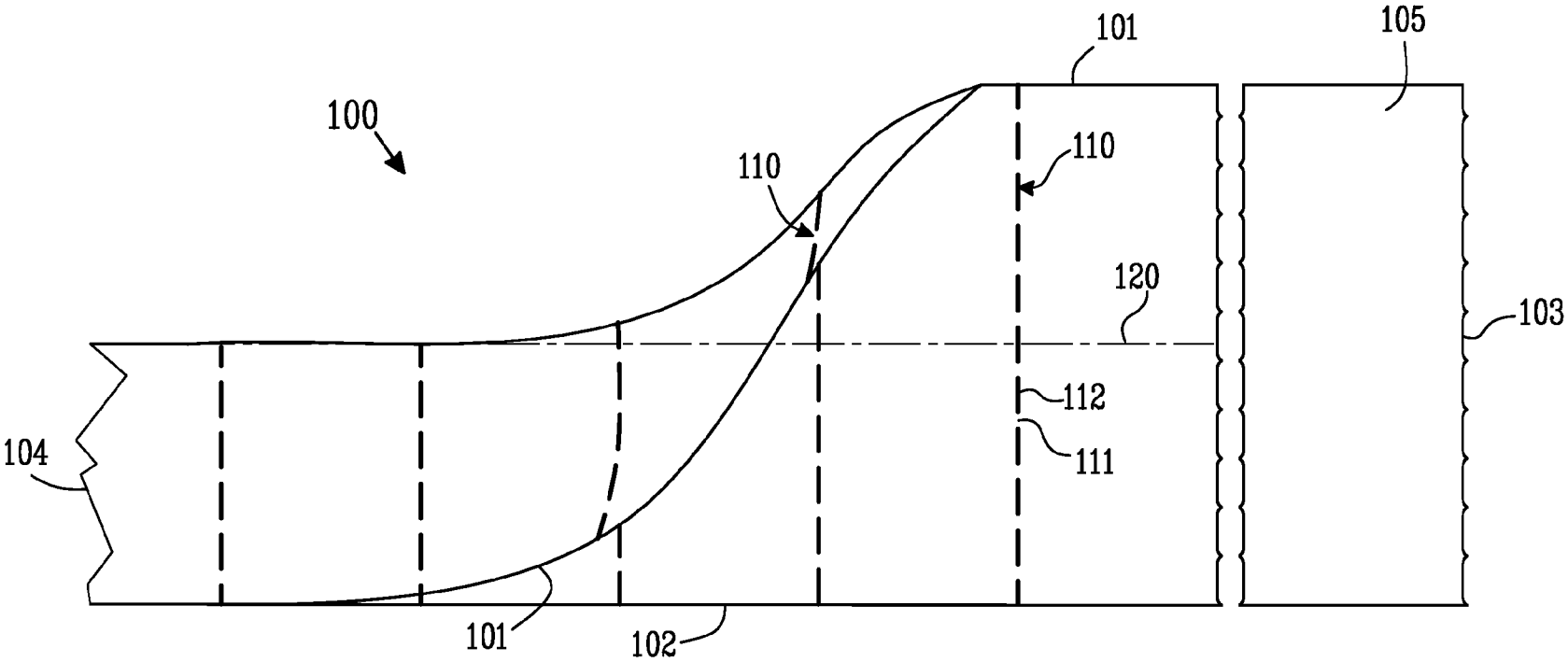
FIG. 1 shows a web according to one embodiment of the invention.
Figure 2:
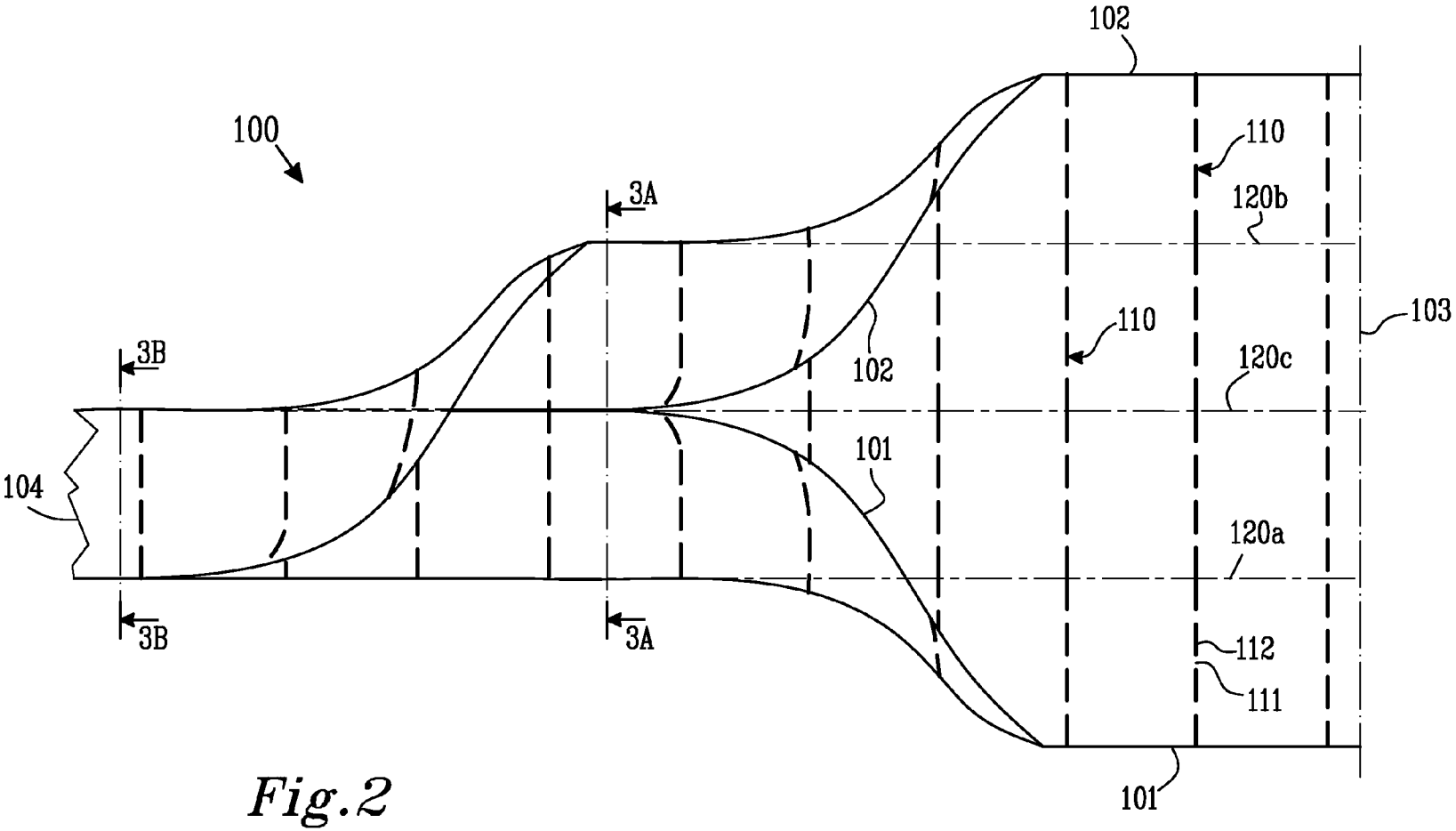
FIG. 2 shows a web according to a second embodiment of the invention.

FIGS. 1 and 2 show web 100 according to the invention, in a partially unfolded state. The web 100 may be e.g. a tissue or a nonwoven web. The web 100 is a strip of generally planar material, with a primary extension in a longitudinal direction (L). The web is defined by first 101 and second 102 longitudinal edges and first 103 and second 104 ends. Typically, the web 100 typically has a length (the extension in the longitudinal direction) of between 10 m and 500 m. For tissue webs, the web preferably has a length of between 10 m and 400 m, while for nonwoven webs, the length is preferably between 10 m and 100 m. The web has a secondary extension in the transverse direction (T); i.e. a width, which typically lies between 10 cm and 100 cm, preferably between 20 cm and 50 cm, more preferably between 20 cm and 30 cm. The longitudinal edges 101, 102 are generally parallel to each other, as are the first and second ends 103, 104.

The web 100 may be selected from a wide range of materials. The web may be a tissue paper, or a nonwoven material, or a hybrid material comprising both natural and synthetic fibres.

The web 100 may comprise natural fibres. Natural fibres useful in the present invention include silk fibers, keratin fibers and cellulosic fibers. Examples of cellulosic fibers include those selected from the group comprising wood pulp fibers, cotton fibers, hemp fibers, grass, bagasse, kemp jute fibers, flax fibers, and mixtures thereof. Wood pulp (i.e. comprising cellulose fibers) is preferred. A commercial example of such a wood pulp material is available from Weyerhaeuser as CF-405. Applicable wood pulps include chemical pulps, such as Kraft (i.e., sulfate) and sulfite pulps, as well as mechanical pulps including, for example, groundwood, thermomechanical pulp (i.e., TMP) and chemithermomechanical pulp (i.e., CTMP). Completely bleached, partially bleached and unbleached fibers are useful. It may be desired to utilize bleached pulp. Also useful in the present invention are fibers derived from recycled paper, which can contain any or all of the above categories as well as other non-fibrous materials such as fillers and adhesives used to facilitate the original paper making process.

The web 100 may alternatively, or additionally comprise synthetic fibres, e.g. fibres formed from polyolefins, polyesters, polyamides, polycarbonates, polyurethanes, polyvinylchloride, polyvinyl acetate, polyvinyl alcohol, polytetrafluoroethylene, polystyrene, polyethylene terephathalate, biodegradable polymers such as polylactic acid and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly(1-butene) and poly(2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polyethylene terephthalate, polytrimethylene terephthalate, polybutylene terephthalate, polytetramethylene terephthalate, polycyclohexylene-1,4-dimethylene terephthalate, and isophthalate copolymers thereof, as well as blends thereof. Thermoplastic fibres such as polyethylene or polypropylene, are preferred.

The web may also comprise semi-synthetic fibres, such as cellulose ester fibers, modacrylic fibers, rayon fibers and mixtures thereof.

The fibres may be short fibres (staple fibers, i.e., fibers which generally have a defined length between about 10 mm and about 60 mm) or continuous fibres.

A preferred web 100 can have from 20-50 wt. % of thermoplastic polymer fibers and 80-50 wt. % of pulp fibers. The preferred ratio of polymer fibers to pulp fibers can be from 25-40 wt. % of polymer fibers and 75-60 wt. % of pulp fibers. A more preferred ratio of polymer fibers to pulp fibers can be from 30-40 wt. % of polymer fibers and 70-60 wt. % of pulp fibers. The most preferred ratio of polymer fibers to pulp fibers can be from 35 wt. % of polymer fibers and 65 wt. % of pulp fibers. Another preferred web comprises 60-80%, preferably around 70% viscose fibres and 20-40%, preferably around 30% polyester fibres.

The fibers of the web 100 may be monocomponent fibers or multicomponent fibers. In addition, the fibers may be shaped or round fibers.

The web 100 may be made in a number of different ways. For example, tissue sheets are typically wet-laid from a fibre slurry. In such a procedures, a web is made by forming an aqueous papermaking furnish (or slurry), depositing this furnish onto a foraminous surface, such as a Fourdrinier wire or double-wire, and by then removing water from the furnish, for example by gravity, by vacuum assisted drying and/or by evaporation, with or without pressing, to thereby form a paper web of desired fiber consistency. In many cases, the papermaking apparatus is set up to rearrange the fibers in the slurry of papermaking furnish as dewatering proceeds in order to form paper substrates of especially desirable strength, hand, bulk, appearance, absorbency, etc. The papermaking furnish can optionally contain a wide variety of chemicals such as wet strength resins, surfactants, pH control agents, softness additives, debonding agents and the like. Papermaking techniques are described in, e.g. U.S. Pat. No. 3,301,746, EP 677,612, U.S. Pat. No. 4,529,480, U.S. Pat. No. 5,073,235

Nonwoven webs 100 may be made by any known method for making nonwoven materials, e.g. meltblowing processes, spunbonding processes, air-laying processes, hydroentangling processes, coforming processes and bonded carded web processes. Suitable processes for forming nonwoven materials are described in U.S. Pat. No. 3,849,241, U.S. Pat. No. 4,340,563 and U.S. Pat. No. 5,350,624

The web 100 may comprise materials other than the base fibres. These additional materials may be present in the fibre mixture from which the web is formed, or may be provided to the web after its formation. For example, the web may comprise absorbent material (e.g. superabsorbent material), pigments, or binders.

After being formed, the web 100 may be after-treated. Suitable after-treatments include embossing, calendaring, patterning, creping, needling, perforating, impregnating, printing with ink, thermal treatment or combinations thereof. The after-treatment may take place over the entire surface of the web, or over only certain regions thereof.

The web 100 may be a laminate of one or more plies, such as two, three or four plies. Plies of a given web 100 may be the same or different in terms of their constitution, the technique used in their formation or their after-treatment.

The plies of the web 100 may be joined to neighbouring plies in any manner. The plies may be joined over the entire surface of the web, or over only certain regions thereof. Joining can be accomplished in a number of ways such as hydroentanglement, needling, ultrasonic bonding, adhesive bonding and thermal bonding. Ultrasonic bonding is performed, for example, as described in U.S. Pat. No. 4,374,888. Thermal bonding of a multilayer laminate may be accomplished by passing the laminate between the rolls of a calendering machine. Lamination of two or more tissue plies can take place via adhesive or mechanical embossing techniques, or a combination of these techniques. Lamination of embossed plies may be in a foot-to-foot, nested or decor fashion.

If the web 100 is a nonwoven web, it may have a basis weight of between 40 and 120 g/cm$^2$, preferably between 60 and 70 g/cm$^2$. If the web 100 is a tissue web, it may have a basis weight of between 12 and 100 g/cm$^2$, preferably between 25 and 50 g/cm$^2$.

It is of particular interest that the web 100 is impregnated with a composition, so that it comprises wet-wipes. Impregnation may be carried out using any known technique, e.g. spraying, rolling or dipping. Non-limiting examples of suitable compositions and methods for their application are described in EP 1 333 868 and the references cited therein.

Of most interest is a web 100 impregnated with a microemulsion. An emulsion is a combination of one liquid finely dispersed in another. For example, the microemulsion may be an oil-in-water or water-in-oil emulsion, preferably oil-in-water. Suitable microemulsions for impregnating into the web 100 are described in WO 99/37747, WO 01/13880, US 2004/0191300 and US 2005/0186167.

If the web 100 is impregnated with a microemulsion, it is important for the pore volume and pore radius in the web 100 to suit the dimensions in the emulsion, so that the emulsion is adequately contained within the web 100, but also so that dirt is effectively encapsulated in the pores of the web 100. As such, the pores of the web may have a pore radius of between 20-60 μm, preferably between 30-50 μm and a pore volume distribution of between 50-400 mm$^3$/μm·g, preferably between 50-250 mm$^3$/μm·g. A suitable method for measuring pore volume distribution is provided in WO 03/069038.

Parameters of the web 100 such as friction or softness can be varied by the skilled person within the scope of the invention, depending on the nature of the web itself and the purpose for which it is intended.

The web 100 comprises a plurality of sheets 105, as seen in FIGS. 1 and 2. Each sheet 105 is defined by a portion of the first 101 and second 102 longitudinal edges of the web 100 and by perforation lines 110 extending between said first 101 and second 102 longitudinal edges of the web 100. Thus, the web 100 consists of a plurality of sheets 105, arranged in an end-to-end fashion in the longitudinal direction L. The sheets 105 are suitably rectangular or square (i.e. the perforation lines 110 are substantially straight and are aligned in the transverse direction) although other shapes are possible (e.g. diamond shapes or curved shapes) depending on the shape and alignment of the perforation lines 110. The length of each sheet 105 (i.e. the distance between adjacent perforation lines 110) can be varied, but typically lies between 5 cm and 50 cm, preferably between 10 cm and 40 cm, more preferably between 15 and 30 cm.

The sheets 105 of the present invention are well suited for a variety of dry and wet cleaning operations such as: mopping floors; cleaning of dry surfaces: cleaning and drying wet surfaces such as counters, tabletops or floors; sterilizing and/or disinfecting surfaces by applying liquid disinfectants; wiping down and/or cleaning appliances, machinery or equipment with liquid cleansers; rinsing surfaces or articles with water or other diluents, removing dirt, dust and/or other debris and so forth. In particular, the laminates of the present inventions have utility in personal care wipes, such as baby wipes, hand wipes or facial wipes. Furthermore, the sheets 105 are disposable after either a single use or a limited number of uses.

Each perforation line 110 comprises at least one perforation 112, and preferably comprises alternating perforation tags 111 and perforations 112. The perforations 112 are defined as the through-holes or openings formed in the web 100 upon perforation, while the perforation tags 111 are defined as the portion of the web 100 which remains unperforated upon perforation. In other words, the sheets 105 are connected to each other in the roll 10 solely by said perforation tags 111 along the perforation lines 110. Perforation can be carried out by any means common in the field, such as e.g. a rotating knife which is passed over the web 100 in the transverse direction (T). In a particular example, a perforation knife available from Fabio Perini S.p.A., Lucca, Italy, with the following characteristics: Knife length=172 cm; Knife width=3 cm; Teeth width=0.8 cm; Tooth height=0.15 cm; Number of teeth=190.5 pcs; was used to provide perforations 112 with a length of 8.0 mm and perforation tags 111 with a length of 1.5 mm. Perforation may also be carried out using lasers or high-pressure water streams.

The number of perforations 112 and perforation tags 111, and the dimensions of the perforation tags 111, should be adapted to e.g. the strength of the web 100 (stronger webs will tolerate fewer, smaller, perforation tags 111) or the perforation method. Preferably, each perforation line 110 will comprise an odd number of perforations 112, and comprises least three, at least five, at least seven, at least nine or at least eleven perforations 112. Perforations 112 typically have a rectangular shape, but may take other shapes, for example, crescent-shaped or circular.

The web 100 is folded along at least one fold axis 120, each of which lies in the longitudinal direction L of the web 100. FIG. 1 shows a preferred embodiment in which the web 100 is folded along one fold axis 120, which is located the same distance from each longitudinal edge 101, 102 of the web. In this case, the web 100 is effectively folded in half about its longitudinal axis so that longitudinal edges 101, 102 meet. However, it is also possible that the fold axis 120 lies closer to one longitudinal edge 101, 102 of the web.

FIG. 2 shows an embodiment in which the web 100 is folded about three fold axes 120. Firstly, the longitudinal edges 101, 102 of the web 100 are folded to the centre of the web 100, by folding about first and second fold axes 120*a*, 120*b*. The web 100 is thus C-folded in the transverse direction (T). This C-folded web is then folded about a third fold axis 120*c*, such that the web 100 is folded in half about its longitudinal axis so that first and second fold axes 120*a*, 120*b* meet.

Figure 3B:
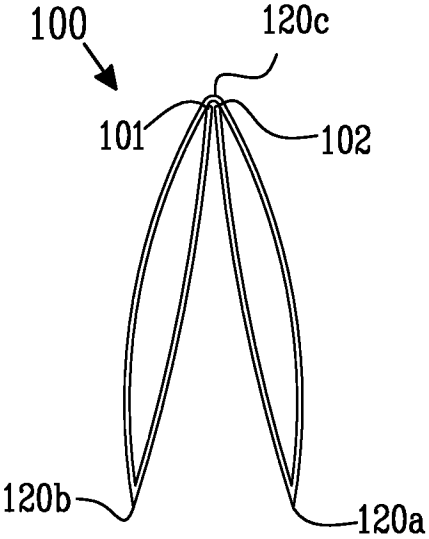
FIG. 3B is a cross-sectional view along the line 3B-3B in FIG. 2.
Figure 3A:
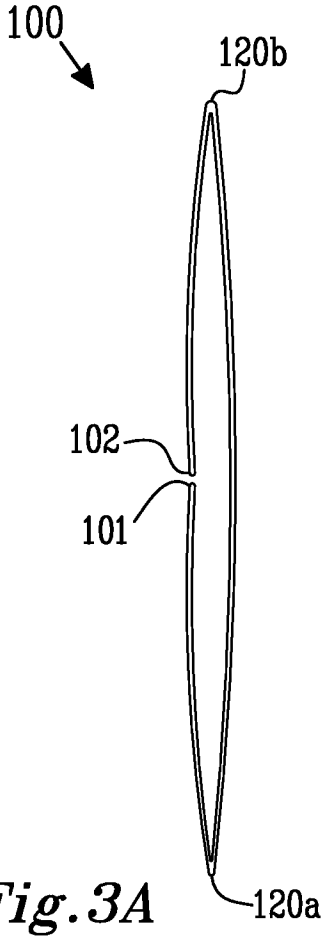
FIG. 3A is a cross-sectional view along the line 3A-3A in FIG. 2.

FIGS. 3A and 3B are a cross-sectional views along the lines 3A-3A and 3B-3B, respectively, in FIG. 2, showing the arrangement of the three folds.

Although the invention has been illustrated with reference to one fold axis 120 in FIG. 1 and three fold axes 120*a*, 120*b*, 120*c* in FIG. 2, this should not be considered as limiting the scope of the invention. One, two, three, four or more fold axes 120 may be present in the web 100. However, odd numbers of fold axes (one, three . . . ) are particularly preferred. In addition, the fold axes 120 are preferably distributed evenly across the transverse direction of the web 100, so that folding the web 100 produces panels of the web with equal width.

The present invention has realised the importance of the relative locations of the perforations 112 and the fold axis 120 for good, reliable dispensing of sheets 105 of web 110. The present invention requires that, at each point at which said at least one fold axis 120 crosses each perforation line 110, the fold axis 120 does not coincide with a perforation tag 111. That is, the fold axis 120 should coincide with a perforation 112 in the perforation line 110. This is clearly shown in FIGS. 1 and 2—the fold axis 120 only overlaps with perforations 112, not perforation tags 111.

Upon folding, therefore, the web 100 has perforations 112 located along one edge thereof—the edge defined by a fold axis 120. This is also shown in FIGS. 1 and 2. The combination of folding and perforating as described ensures that a sharp starting point is provided at the edge defined by the fold axis 120 when a user tears off sheets 105. In effect, notches are formed by the perforations 112 in the folded edge of the web 100. Longitudinal tension forces in the web 100 will tend to concentrate along the folding axis 120, as the longitudinal edges 101, 102 of the web 100 are not bonded to one another. In addition, the double thickness of the web 100 at this edge provides strength in the region outside the perforation 112. All of these features simplify the separation of individual sheets 105 in a consistent manner.

In order to promote that a perforation 112 coincides with the fold axis 120, the extension of the perforations 112 in the direction of the perforation line 110 may be greater than the extension of the perforation tags 111 in the direction of the perforation line 110. The extension of the perforations 112 in the direction of the perforation line 110 may in fact be at least twice, preferably at least five times, more preferably at least ten times, most preferably at least twenty times, the extension of the perforation tags 111 in the direction of the perforation line 110. In effect, the sheets 105 are joined in the web 100 by thin perforation tags 111, as shown in FIGS. 1 and 2. Suitably, the perforation tags 111 have an extension in the direction of the perforation line 110 which is less than 5 mm, preferably less than 3 mm, more preferably less than 2 mm, most preferably less than 1 mm.

Figure 4:
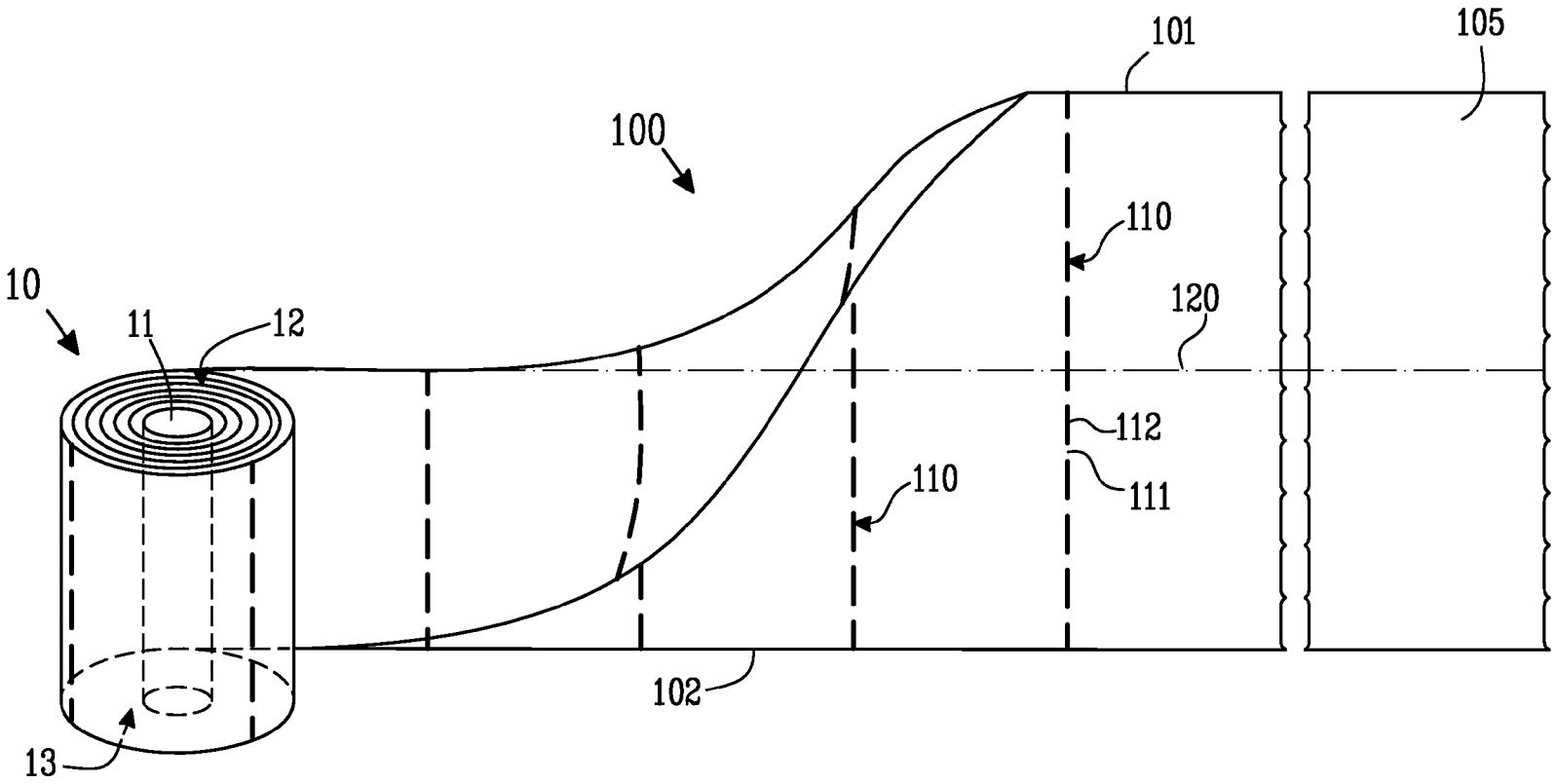
FIG. 4 shows an edge-feed roll comprising the web of FIG. 1.
Figure 5:
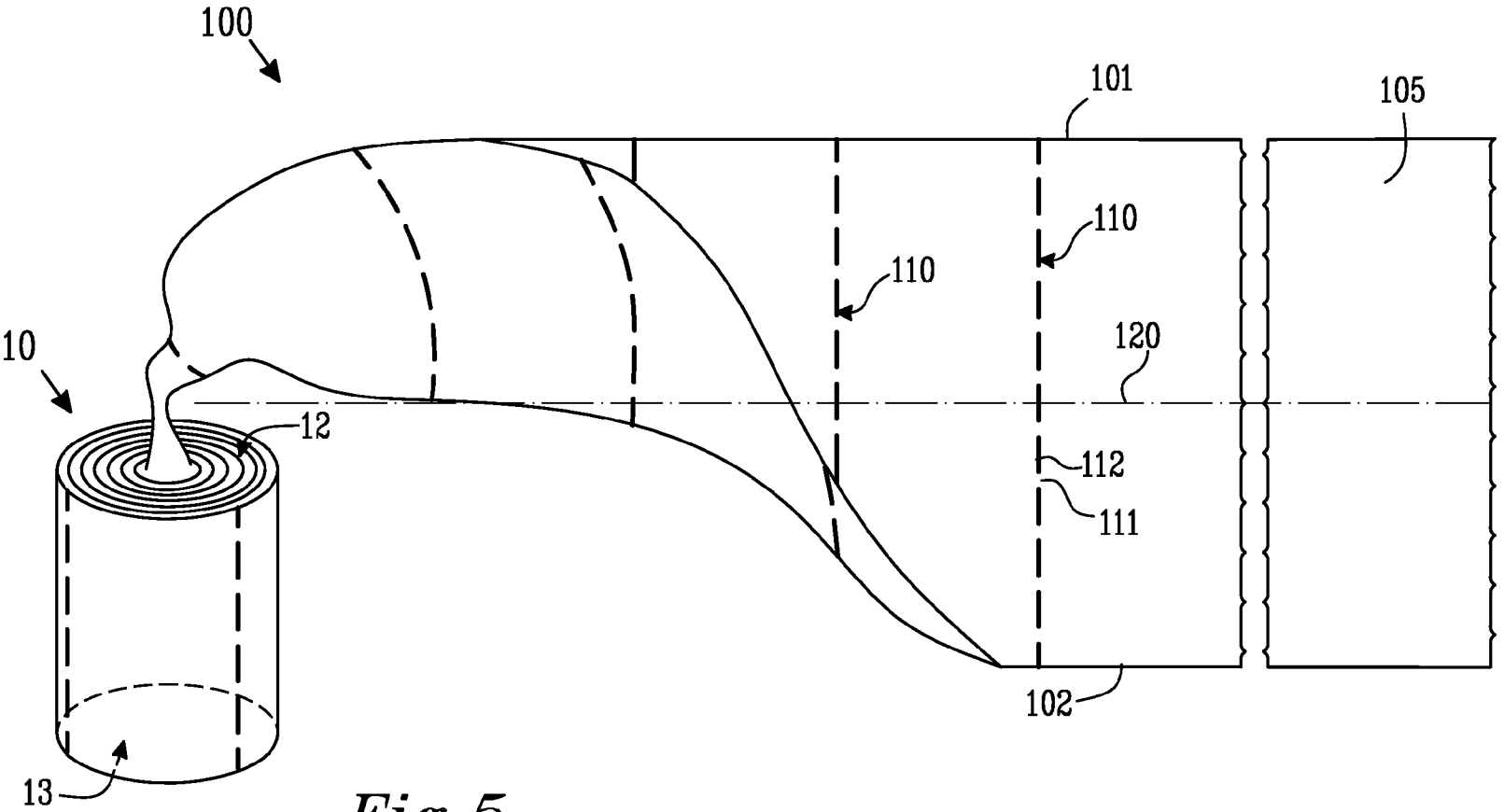
FIG. 5 shows a centre-feed roll comprising the web of FIG. 1.

FIGS. 4 and 5 show rolls 10 of web 100 according to the invention. For simplicity, the web 100 of FIG. 1 (with a single, central fold axis 120) is illustrated, in a partially unrolled, unfolded state.

The roll in FIG. 4 is an edge-feed roll, meaning that the web 100 is dispensed by unwinding it from the perimeter of the roll 10. Edge-feed rolls can be formed by rolling web 100 around a core 11. The core 11 may comprise a compressed and/or glued core of web, about which the remaining web 100 is rolled. Alternatively, the core 11 may be a separate component of the roll 10, such as that found in a typical toilet roll. Edge-feed rolls may also be coreless—such rolls are typically formed by wrapping web 100 around a spindle, which is subsequently removed (e.g. by collapsing the spindle). The free (outer) end of the web 100 is secured to the roll 10 by any known method (e.g. using glue or a separate piece of material) to prevent unraveling. Coreless rolls are further described in WO 06/130057 and WO 06/080869.

The roll 10 of FIG. 5 is a centre-feed roll, in that web 100 is dispensed by unwinding it from the centre of the roll 10. Such rolls are typically manufactured as coreless rolls—by winding web 100 on a spindle which is then removed. To initiate dispensing from a centre-feed roll, the central portion of the roll is first pulled out, allowing web 100 to follow. Centre-feed rolls are further described in US 2007/262187 and EP 1 667 563.

The rolls 10 illustrated in FIGS. 4 and 5 are generally cylindrical. Typically, the rolls 10 of the invention have a diameter of between 5 cm and 55 cm, preferably between 10 cm and 40 cm, and an end-to-end length of between 10 cm and 50 cm, preferably between 10 cm and 30 cm. The roll 10 may be packaged for delivery in a wrap or box.

The roll 10 comprises web 100. In FIGS. 4 and 5, the first end 103 of the web 100 lies innermost in the roll 10, while the second end 104 lies outermost—which end is dispensed first depends on whether the roll 10 is centre-feed or edge-feed. When web 100 is dispensed from the roll 10, it should separate at the perforation lines 110 so as to provide individual sheets 105.

Figure 6:
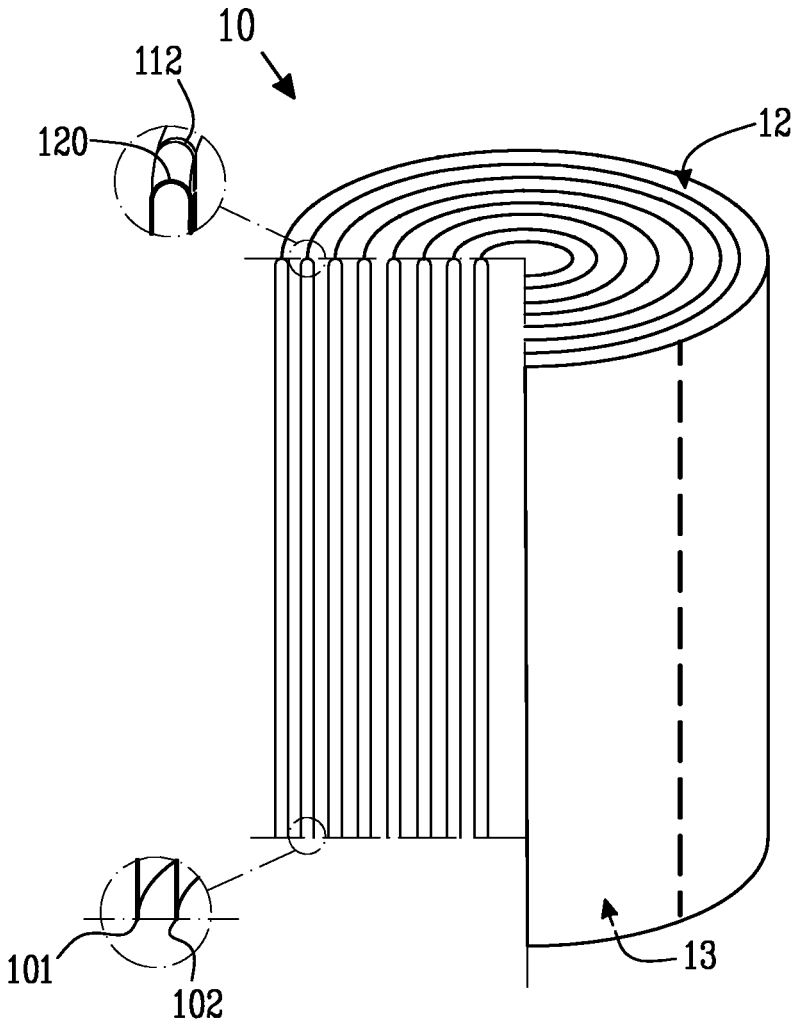
FIG. 6 is a cross-sectional view taken through the roll of FIG. 4 or 5.

The web 100 is rolled into the roll 10 in this folded state, as can be seen in FIGS. 4 and 5. When rolled, therefore, one end face 12 of the roll 10 is constituted by the fold axis 120, while the other end face 13 of the roll 10 is constituted by the longitudinal edges 101, 102 of the web 100. This can be see in FIG. 6, which is a cross-sectional view taken through the roll 10 of FIG. 4 or 5. Dispensing of the web 100 from the roll 10 of FIG. 6 takes place most readily from the end face 12 constituted by the fold axis 120, as the forces are applied through the fold axis 120. This is shown clearly in the expanded views in FIG. 6: one end face 12 of the roll 10 constitutes the fold axis 120, interdispersed with perforations 112. The other end face 11 of the roll 10 constitutes the two longitudinal edges 101, 102 of the web 100.

Figure 7:
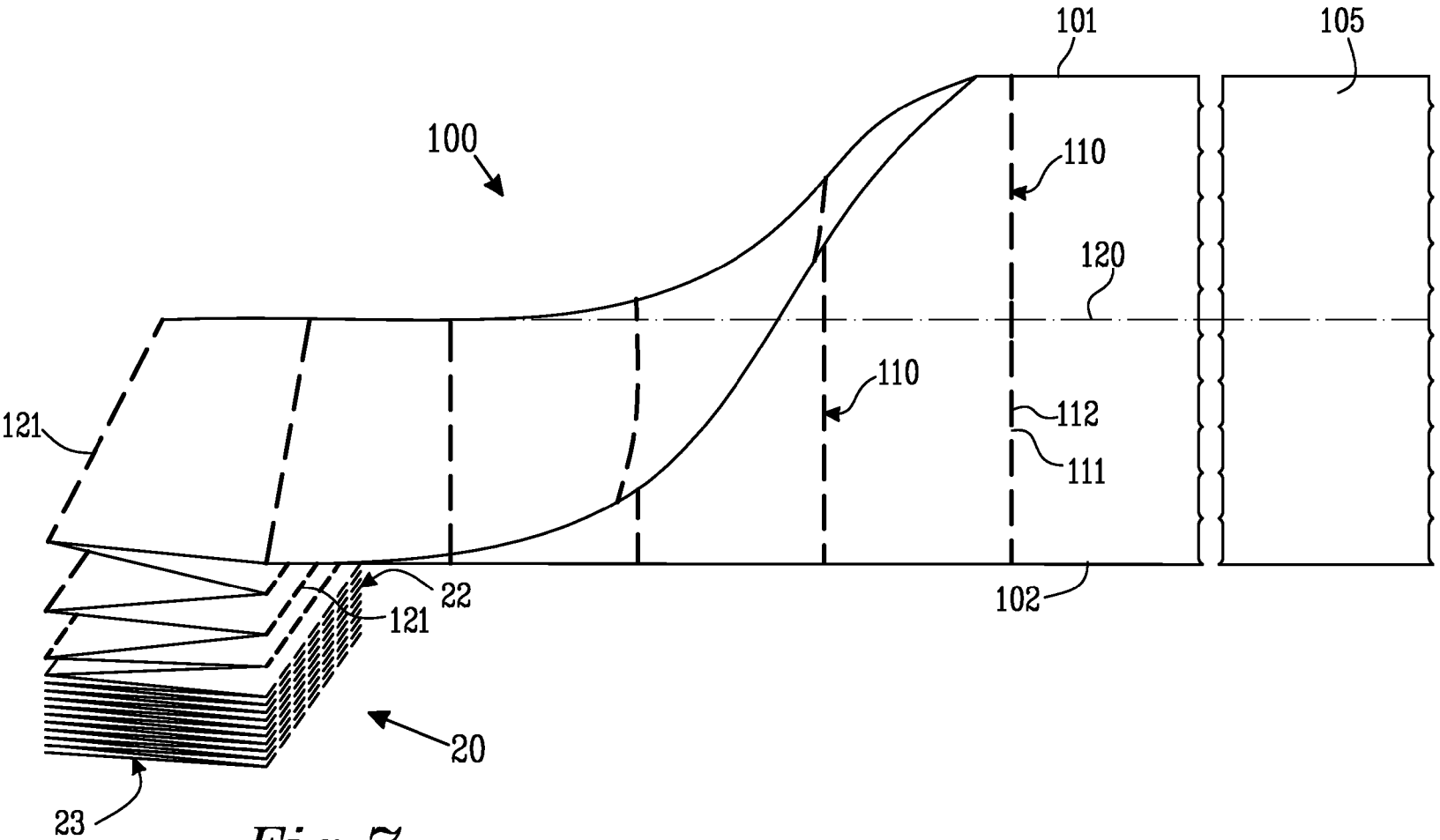
FIG. 7 shows a stack comprising the web of FIG. 1, FIGS. 8A and 8B show a dispenser according to the invention

FIG. 7 shows the web 100 of FIG. 1 in the form of a stack 20, in a partially unfolded state. In the stack 20, the web 100 has been folded along a plurality of transverse fold axes 121, each of which lies perpendicular to the longitudinal direction L. In a similar way to the roll 10, one end face 22 of the stack is constituted by the fold axis 120, while the other end face 23 of the stack 20 is constituted by the longitudinal edges 101, 102 of the web 100. Dispensing of the web 100 from the stack 20 of FIG. 7 takes place most readily from the end face 22 constituted by the fold axis 120, as the forces are applied through the fold axis 120. Any arrangement of transverse fold axes 121 is possible; however, it is preferred that adjacent transverse fold axes 121 are equally spaced to provide an even stack 20.

There are two possible methods for forming the web 100 according to the invention. The first method comprises the steps of:

a. providing a web having a primary extension in a longitudinal direction (L) and being defined by first 101 and second 102 longitudinal edges and first 103 and second 104 ends;
b. providing the web 100 with longitudinally-spaced perforation lines 110 which extend between said first 101 and second 102 longitudinal edges and comprise alternating perforation tags 111 and perforations 112;
c. folding the perforated web 100 about at least one fold axis 120, each of which lies in the longitudinal direction of the web; such that, at each point at which the at least one fold axis 120 crosses each perforation line 110, the fold axis 120 does not coincide with a perforation tag 111.

Alternatively, the steps of perforating and folding may be carried out in reverse order, so that the second method comprises the steps of:

a. providing a web having a primary extension in a longitudinal direction (L) and being defined by first 101 and second 102 longitudinal edges and first 103 and second 104 ends;
b. folding the perforated web 100 about at least one fold axis 120, each of which lies in the longitudinal direction of the web;
c. providing the folded web 100 with longitudinally-spaced perforation lines 110 which extend between said fold axis 120 and first 101 and second 102 longitudinal edges and which comprise alternating perforation tags 111 and perforations 112, such that, at each point at which the at least one fold axis 120 crosses each perforation line 110, the fold axis 120 does not coincide with a perforation tag 111.

Perforating a folded web 100 allows greater accuracy in the placement of the perforation lines 110 in the resulting web 100 than does folding a perforated web 100, so the second method may be preferred. On the other hand, if the web 100 is relatively thick, perforating a folded web 100 may not be easy, and it may therefore be advantageous to use the first method.

When forming a web 100 in the form of a roll 10, either method additionally comprises the step of rolling the folded, perforated web into a roll 10 about the first 103 or second end 104 (of the web 100).

When forming a web 100 in the form of a stack 20, either method additionally comprises the step of folding the folded, perforated web 100 along a plurality of transverse fold axes 121 each of which lies perpendicular to the longitudinal direction (L).

FIGS. 8 and 9 show a dispenser 200 comprising the roll 10 according to the invention. The dispenser 200 comprises an opening 210 through which said web 100 is dispensed. The dispenser 200 can take any shape which is suitable for containing the roll 10, but is preferably substantially cylindrical in form. It has dimensions which are suitable for containing the roll 10, but are not substantially larger. The dispenser 200 may be made of plastic, metal or card, or combinations of these materials, plastic being preferred. The dispenser 200 comprises a housing 202 and a dispensing opening 210 through which said web 100 is dispensed. The housing 202 can preferably be opened to allow the dispenser 200 to be refilled, for example, the housing 202 comprises two parts which are assembled around the web 100 (e.g. a lid 202*a* and a base 202*b*).

The dispenser 200 in FIG. 8 is a portable dispenser 200 having the form of a base 202*b* with a lid 202*a* and a handle 204. This dispenser 200 sits on a horizontal surface and sheets 105 of web 100 are drawn upwards through the dispensing opening 210 in the lid 204. Alternatively, the dispenser 200 of FIG. 8 can be hung from the handle 204 with the dispensing opening 210 facing downwards.

The dispenser 200 in FIG. 9 is a wall-mounted dispenser 200, in which part of the housing 202 is attached to a vertical surface such as a wall. Sheets 105 of web 100 are drawn downwards through the dispensing opening 210. The dispenser 200 in FIG. 4 also comprises a viewing opening 205, which allows a user to see how much web 100 remains in the dispenser. The skilled person can select a suitable location for the viewing opening 205 for best effect.

The roll 10 is preferably arranged in the dispensers 200 of FIGS. 8 and 9 such that web 10 is dispensed from the end face 12 of the roll 10 which is constituted by the fold axis 120. In other words, it is this end face which is located adjacent the dispensing opening 210 (upwards in FIG. 8, downwards in FIG. 9).

The dispensing opening 210 may take a number of forms, such as e.g. an elongated slit or a hole such as a circular hole. The dispensing opening 200 may be covered by a cap 206 when not in use, which seals the dispensing opening 200, so as to further prevent wet web 100 from drying out and to protect it from dust and dirt. The dispenser 200 may comprise a dispensing insert 201 in which the dispensing opening 210 is located, said dispensing insert 201 being formed of an elastic material, such as e.g. silicone or rubber, which returns to its original shape after being deformed. The dispensing insert 201 will deform when web 100 is dispensed, and the elastic forces which act to return it to its original form will grasp the following sheet 105, promoting good separation of the sheets 105. This feature, in combination with the arrangement of perforations 112 in the web 100 described above, promotes accurate, reliable separation of the sheets 105 during dispensing. An elastic dispensing insert 201 also reduces the chances of the web 100 falling back into the dispenser. The following sheet 105 sticks up from the dispensing opening 210 a short way, such as between 0.5 and 2 cm, which is enough that it can be grasped by a user, but not enough that wet web dries out too much. In addition, compression of the web 100 by the dispensing insert 201 allows a good seal to be achieved, again limiting drying out of wet web.

Figure 8B:
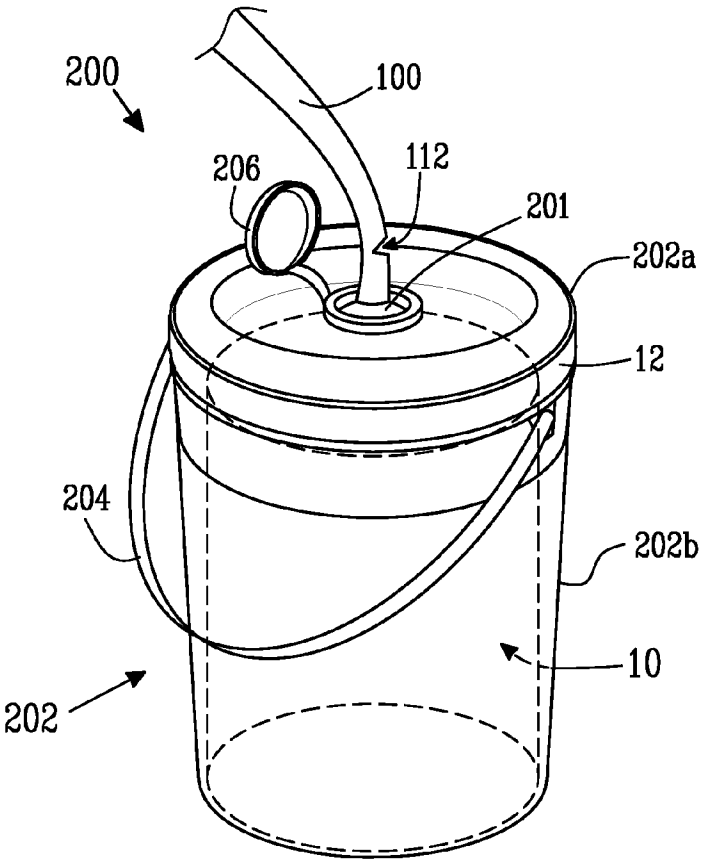
Figure 8A:
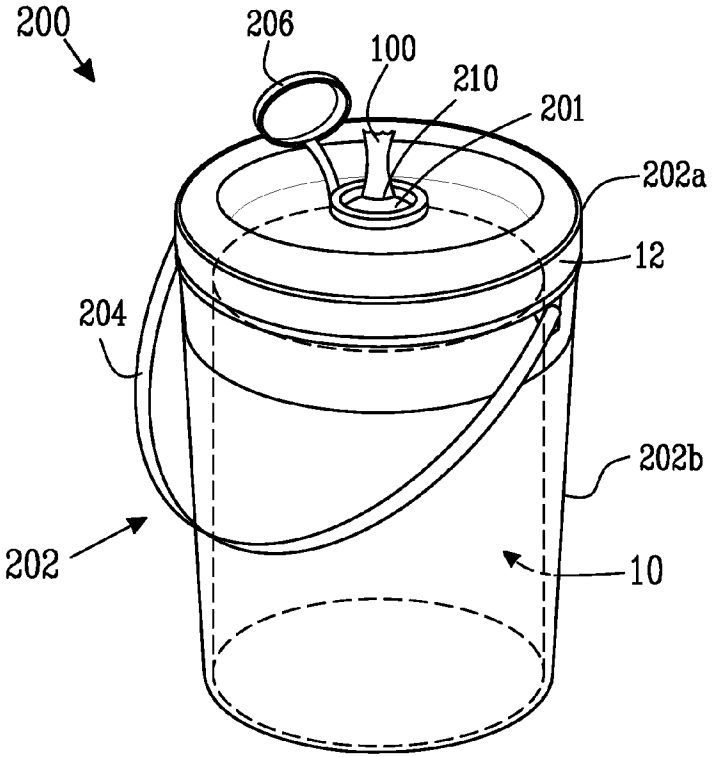
Figure 9B:
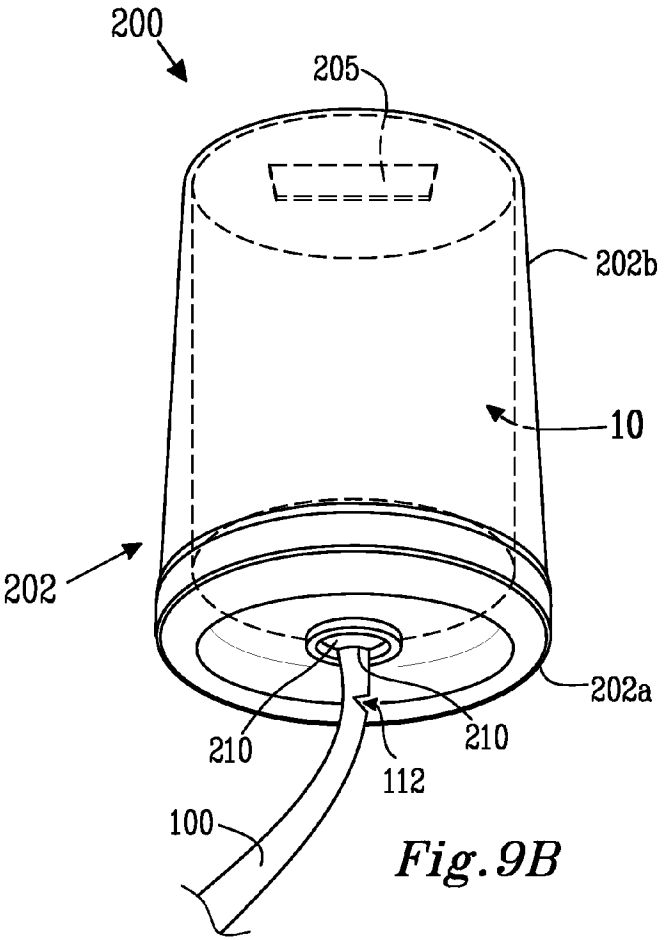
FIGS. 9A and 9B show an alternative dispenser according to the invention
Figure 9A:
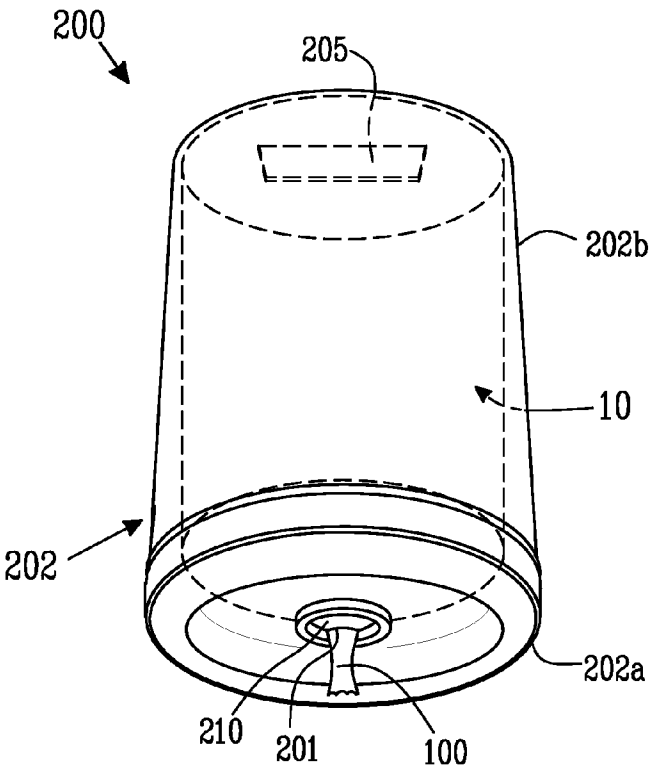

FIGS. 8A and 9A show the dispensers 200 prior to use. A short length of web 100 sticks up from the dispensing opening 210 a short way, such as between 0.5 and 2 cm, which is enough that it can be grasped by a user, but not enough that wet web dries out too much. When a user pulls on the web 100, web 100 is drawn from the dispenser 200. When a perforation line 110 passes through the dispensing opening 120, the situation illustrated in FIGS. 8B and 9B is established, in which the perforation 112 located on the fold line 120 is stretched in the longitudinal direction of the web 100, so as to form a well-defined tearing point for the web 100. A sheet 105 of the web 100 separates at this point, again leaving a short length of web sticking up from the dispensing opening 210. The design of the web 100 of the invention (especially when used in the dispenser 200 of the invention) makes it very difficult to remove two sheets 105 in a single dispensing action (i.e. double-dispensing is essentially eliminated).

Dispensing of sheets 105 from the roll 10 of the invention is particularly effective when the opening 210 has a dimension in the transverse (T) direction of the web which is less than the width of the web 100 itself, so that the web 100 must be compressed to pass through the dispensing opening 210. In particular, the dispensing opening preferably has an area of between 0.8 $mm^2$-20 $mm^2$, such as between 1 $mm^2$-10 $mm^2$, as measured in the plane which is substantially perpendicular to the direction in which web 100 is primarily dispensed, and when no web is present in the dispensing opening 210 (i.e. before dispensing is initiated). During dispensing, the size of the dispensing opening 210 varies with the thickness of the web 100, the amount of folding/compression required to pass the web 100 through the opening 210, and the tension in the web 100 during dispensing.

The dispensers 200 illustrated in FIGS. 8 and 9 can be adapted to contain a web 100 in the form of a stack 20. In this case, the dispensers 200 may have an essentially cuboid form, e.g. a tissue box. As for the roll 10, dispensing of web 100 from the stack 20 preferably takes place from the end face 22 of the stack which is constituted by the fold axis 120.

The invention should not be considered limited by the above description and Figures, but should instead be determined by the appended claims. In particular, features from different embodiments may be combined by the skilled person within the scope of the invention.

The invention claimed is:

1. A web having a primary extension in a longitudinal direction and being defined by first and second longitudinal edges and first and second ends, said web comprising a plurality of sheets arranged in an end-to-end fashion in the longitudinal direction;

each sheet being defined by a portion of the first and second longitudinal edges of the web and by perforation lines which extend between said first and second longitudinal edges;

said perforation lines comprising at least one perforation;

wherein the web is folded along at least one fold axis, each of which lies in the longitudinal direction of the web and crosses said perforation lines;

said web being in the form of a roll, which has been rolled about the first or second end; and wherein at each point at which each of said at least one fold axis crosses each perforation line, the fold axis coincides with a perforation.

2. The web according to claim 1, wherein said at least one fold axis lies in the longitudinal direction of the web.

3. The web according to claim 2, wherein said at least one fold axis is located the same distance from each longitudinal edge.

4. The web according to claim 1, wherein each perforation line comprises alternating perforation tags and perforations such that adjacent sheets are connected solely by said perforation tags.

5. The web according to claim 4, wherein the extension of the perforations in the direction of the perforation line is greater than the extension of the perforation tags in the direction of the perforation line.

6. The web according to claim 5, wherein the extension of the perforations in the direction of the perforation line is at least twice the extension of the perforation tags in the direction of the perforation line.

7. The web according to claim 4, wherein each perforation tag has an extension in the direction of the perforation line which is less than 5 mm.

8. The web according to claim 1, wherein each perforation line extends substantially in a transverse direction, being perpendicular to the longitudinal direction in the plane of the web.

9. The web according to claim 1, wherein the web is a tissue web.

10. The web according to claim 1, wherein the web is a nonwoven web.

11. The web according to claim 1, wherein the web is a wet-wipe.

12. The web according to claim 11, wherein the wet-wipe is impregnated with an emulsion.

13. A dispenser comprising the web according to claim 1, said dispenser further comprising a dispensing opening through which said web is dispensed.

14. The dispenser according to claim 13, wherein the dispensing opening has a form selected from the group consisting of: circular, square, rectangular or slit-shaped.

15. The dispenser according to claim 13, comprising a dispensing insert in which the dispensing opening is located, said insert being formed of an elastic material.

16. The dispenser according to claim 13, wherein the dispensing opening has an area of between 0.8 $mm^2$-20=$^2$.

17. The dispenser according to claim 13, further comprising a cap adapted to cover the dispensing opening when the dispenser is not in use.

18. A method for forming a web comprising the steps of:

a. providing a web having a primary extension in a longitudinal direction and being defined by first and second longitudinal edges and first and second ends;

b. providing the web with longitudinally-spaced perforation lines which extend between said first and second longitudinal edges and comprise at least one perforation;

c. folding the perforated web about at least one fold axis, each of which lies in the longitudinal direction of the web; such that, at each point at which the at least one fold axis crosses each perforation line, the fold axis coincides with a perforation; and d. rolling the folded, perforated web into a roll about the first or second end.

19. A method for forming a web comprising the steps of:

a. providing a web having a primary extension in a longitudinal direction and being defined by first and second longitudinal edges and first and second ends;

b. folding the web about at least one fold axis, each of which lies in the longitudinal direction of the web;

c. providing the folded web with longitudinally-spaced perforation lines which extend between said fold axis and first and second longitudinal edges and which comprise at least one perforation, such that, at each point at which the at least one fold axis crosses each perforation line, the fold axis coincides with a perforation; and d. rolling the folded, perforated web into a roll about the first or second end.

* * * * *